United States Patent [19]

Briggs

[11] 4,211,047

[45] Jul. 8, 1980

[54] STRUCTURAL SPANNING MEMBER

[76] Inventor: Martin H. Briggs, The Mound, White Hill, Caterham, England

[21] Appl. No.: 884,196

[22] Filed: Mar. 7, 1978

[30] Foreign Application Priority Data

Mar. 23, 1977 [GB] United Kingdom ..... 12228/77

[51] Int. Cl.[2] ..... E04D 1/00

[52] U.S. Cl. ..... 52/522; 52/588; 52/478

[58] Field of Search ..... 52/579, 588, 537, 478, 52/86, 536, 538, 522, 630

[56] References Cited

U.S. PATENT DOCUMENTS

| | | | |
|---|---|---|---|
| 2,812,730 | 11/1957 | Hermann | 52/630 X |
| 3,229,436 | 1/1966 | Gerhart et al. | 52/588 X |
| 3,535,836 | 10/1970 | Blaski | 52/86 X |
| 3,559,359 | 2/1971 | Talbert | 52/522 X |
| 3,968,603 | 7/1976 | Merson | 52/588 X |

*Primary Examiner*—Price C. Faw, Jr.

*Assistant Examiner*—Carl D. Friedman

*Attorney, Agent, or Firm*—Watson, Cole, Grindle & Watson

[57] ABSTRACT

A roof is assembled conventionally from cladding supported by purlins or girders extending between end walls of the building. The cladding can be metal. By providing a single structural spanning member, the requirement for girders or purlins is avoided and construction work is simplified. The usefulness of the structural spanning member is measured by the unsupported span that can be erected when the member is formed from sheeting material of stock width, conventionally with steel 1 or 1.2 meters, of a given thickness and rigidity. This member achieves the desired solution by a novel configuration in which the whole width of sheeting is utilized to form a single member having a top chord spaced from a bottom chord by a strengthened web, wherein pairs of chords of adjacent members nest to provide a single pitch of the roof.

14 Claims, 23 Drawing Figures

1
11
1
11

160
130
110
1
140
150
110

1
120
121

150

120
121

STRUCTURAL SPANNING MEMBER

BACKGROUND TO THE INVENTION

This invention relates to a structural spanning member capable of use in constructional engineering structures such as roofings, floorings and walls for buildings and deckings for bridges in which the member is positioned to extend between end supports and which comprises a web and a pair of chords connected to the web and directed mutually oppositely to each other with respect to the web.

Known decking structures comprise girders or other load bearing members spanning between end supports, which members carry cladding of lighter gauge material, usually metal and often steel. Such cladding, which is not itself a structural member, comprises a series of webs and chords formed in a single sheet.

At Salford University in the United Kingdom a roofing structure was proposed in which a zig-zag configuration was obtained by having a series of alternate truncated V-shaped girder chords and inverted truncated V-shaped girder chords of structural rigidity, with each chord formed as a separate member, and a plurality of separate web members extending between each V-shaped chord and its adjacent inverted V-shaped chord, the plurality of web members extending in laterally contiguous relationship from one and the wall to the other, said web members being formed of light gauge metal sheeting, the longitudinal dimension of which, in elevation, is arranged between the chords. The web members were formed from pressed sheet normally available only in cut lengths of several meters. The web members were stiffened so as to assist in the structural function of the structure, hereinafter referred to as "a spanned-chord structure".

When considering the material available to form these spanned chord structures, certain basic data concerning the strip sheeting produced by strip mills in the United Kingdom is recognised. The strip mills produce sheeting in continuous lengths which conveniently are supplied to the finishing manufacturers in coils. It may be finished as pressed sheet in lengths of several meters. This sheeting will be referred to herein as "light gauge" if it has a thickness in a range of 0.6 to 1.4 mm, and as "heavy gauge" if it has a thickness in a range of 1.6 mm and upwards.

In the spanned chord structure, the material employed was steel and the chords were fabricated from folded plate, whilst the web members extending longitudinally between the chords were of light gauge sheeting. These web members of pressed sheeting were up to 2 meters in length whilst utilizing the maximum width of the sheeting available from the rolling mills.

With this spanned chord structure in which both the chords and the web members are structural members, each pitch comprises a first lower truncated upright V-shaped chord joined by a plurality of web members to an upper inverted truncated V-shaped chord itself joined by a plurality of web members to a second lower upright truncated V-shaped chord. The joining operations are effected by the use of self-drilling, self-tapping screws between each web member and its upper and lower V-shaped chords, and between each web member and the web member(s) contiguous with it. Of necessity, for each roof structure of one or more pitches, these steps in the fabrication are carried out at ground level and then that complete roof structure is raised into position; the raising being accomplished by equipment such as hydraulic jacks.

In this spanned-chord structure, the light gauge pressed sheeting has not been employed so that its longitudinal dimension extends across the roof span.

Where in another prior art the longitudinal dimension of the light gauge sheeting extends across the building span, it extends merely as cladding between truss members or portal frames whilst itself being supported by girders or purlins. Thus, previously cold rolled light gauge sheeting has been used solely as cladding or covering for roof spans. The maximum strip width of 1.2 meters is formed with a plurality of laterally extending ridges and employed to cover a plurality of girders or purlins when the longitudinal dimension of the spanning member is also the longitudinal dimension of the sheeting leaving the mill.

In practice, this has resulted in decking sheets which when seen in lateral section have a series of trapezoidal upper and lower chords, with a depending dimension between upper apex and lower apex of usually less than 100 mm. Currently from cold rolling finishing mills producing sheeting in trapezoidal form, this depending dimension varies according to geographical source with British product being a maximum 63 mm, Italian 75 mm and Swedish 100 mm. This cold rolled sheeting itself is capable of being employed as a structural member for roofing between side walls or portal members where the intermediate spacing is only between three and six meters. For most practical roofing purposes the span or spacing to be bridged is 7 meters minimum and may be up to 20 meters.

Other recent proposals for decking structures by Norrbottens Jarnverk AB of Sweden are shown in Swedish Patent Applications Nos. 75 04906-4 dated 28th Apr. 1975 and 75 06556-5 of 9th June 1975. These disclose the use of individual sheeting members, each sheeting member having a configuration which, when seen in lateral section, comprises a single complete trapezoidal section. Such sheeting members are sold inter alia for use as structural spanning members per se. However, it should be appreciated that even these sheeting members are of limited longitudinal span because of the width of sheeting available (1.2 meters) is contoured to provide the whole member. The whole member comprises a pair of laterally projecting lower chords for connection to adjacent members, and a pair of webs each upwardly directed from a respective lower chord and an upper chord extending between the webs. The upper chord is strengthened by laterally extending embossing or indentations and the webs are stiffened along their length by longitudinally extending ridges. Since the rigidity of the sheeting is primarily determined by the spacing between the upper chord and the lower chords, the fact that the upper chord is approximately 550 mm of the available width of 1.2 meters still places a limitation on the unsupported span of these single trapezoidal-sectioned structural members.

The reason is that whilst the embossing of the upper chord increases bending resistance due to cladding superimposed on the chord, the embossed part of the chord has to be disregarded in calculating the unsupported span for which the member may be used.

The present invention has the object of providing a structural spanning member which from the available widths of sheeting is designed to maximize the unsupported span which the member may bridge.

An additional but related object is to permit the avoidance of the use of purlins and other intermediate support members to achieve economy in building costs.

A further object is to provide a structural spanning member which together with like members provides a weather proof roof which does not of necessity require additional water proofing with bitumens, felt or asphalt.

SUMMARY OF THE INVENTION

According to the present invention there is provided a structural spanning member capable of use in constructional engineering structures such as roofing, flooring and walls for buildings and deckings for bridges in which the member is positioned to extend between end supports, comprising a web and a pair of chords connected to the web and directed mutually oppositely to each other with respect to the web, characterized in that only a single pair of chords and the web are integral and formed from a single width of sheeting material, the web is stiffened for structural use, and the pair of chords are disposed relative to the web such that the geometry of the upper and lower chords together with the web have a configuration which enables a like pair of structural spanning members to be assembled to provide a single pitch of a constructional structure, whereby the member is capable of extending between end supports without intermediate supporting members.

The preferred material for the structural spanning member is still light gauge steel sheeting, but heavy gauge and other metals may be practicable. In addition, it is also considered probable that the sheeting material could be formed of glass reinforced plastics material (G.R.P.)

The preferred configuration of the structural spanning member is one in which the upper and lower chords are of complementary contour to allow nesting of chords of adjacent members, one of the upper and lower chords may be arranged to resiliently snap-fit into position when nested.

This latter feature greatly reduces the need for fastenings, although these may be provided in situ between the two upper chords to provide increased strength in compression.

When formed of steel, the sheeting material is cold rolled. The web is stiffened preferably by being indented laterally of the web during the rolling operation. The nesting chords are also formed during the cold rolling operation. In this manner, production is practicable even within the width limitation of continuous strip of 1.2 meters.

Structural spanning members fabricated from 0.7 to 1.2 mm thick sheeting with web depths from 450 to 900 mm are believed to be capable of spanning from 10 meters to 18 meters when carrying a superimposed snow load of 0.75 $KN/m^2$. Over the shorter spans or with lighter loading the top chord fastenings may not be required.

In one preferred embodiment, the chords have parallel planar portions extending in opposite directions from the web which is inclined at an angle 45° to each planar portion. This angle of 45° may be varied, and is an important parameter in the calculation of the area of sheeting required for a given roof area, or expressed differently, the area covered by one pitch of the roofing.

In this embodiment both chords are of like contour and are dimensioned such that in use when each of a contiguous pair of structural spanning members are inverted with respect to the vertical and to each other, then immediately adjacent chords are arranged to resiliently snap-fit into position when nested.

In a second preferred embodiment the chords are dissimilar and with one chord having a configuration such that in use a pair of these structural spanning members are connected by turning alternate members endwise to enable the nesting of uppermost chords of like configuration from each member.

In the preferred embodiments the structural spanning member will be described in relation to roofing. Other applications envisaged include floors, bridge decking and wall cladding. It is also envisaged that complete structures may be formed from these structural spanning members.

BRIEF DESCRIPTION OF DRAWINGS

Embodiments of the invention will now be described by way of example only, with reference to the accompanying drawings in which.

DETAILED DESCRIPTION OF EMBODIMENTS

Figure 1:
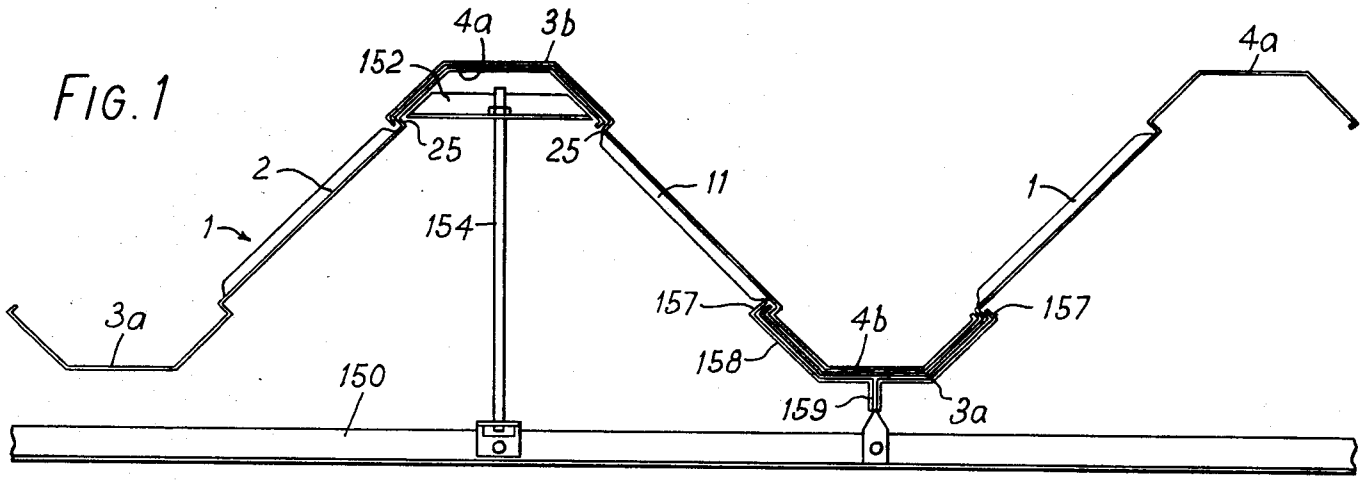
FIG. 1 shows schematically in elevation a roofing section assembled from a first, preferred structural spanning member.

In FIG. 1 an individual spanning member 1 comprises a web 2 connecting a pair of oppositely directed chords 3,4. A pair of members 1,11 joined at an upper and lower chord 4*a*, 3*a* (3*b*,4*b*) form a trapezoidal decking configuration. As shown in a roofing section, a complimentary pair of structural spanning members 1,11 forming a single pitch. The chords 3,4 and the web 2 are formed in a continuous cold rolling process from a single width of a continuous length of steel sheeting or strip which is available from conventional steel strip mills. The web 2 is stiffened for structural use as will be later described. The upper and lower chords 4*a*,3*a* (3*b*,4*b*) are of complementary contour (as further described below) to allow nesting of chords of adjacent members (1,11). The upper chord 4*a* of member 1 is arranged to resiliently snap fit into its nested position in a chord 3*b* of member 11. When nested the lower chords 4*b*,3*a* are not secured together by fastenings, such as the self-drilling, self-tapping screws which are used in situ to strengthen the connection between the nesting upper chords 4*a*,3*b*.

Clearly the left and right hand structural spanning members 1 and 11 of a pair forming a single pitch are similar but of opposite orientation, i.e., member 11 is member 1 inverted. This means that an entire roofing span is formed from a single component capable of assembly in situ. It is preferred to raise the members 1,11 in pairs constituting one pitch of a roofing section.

Figure 2:
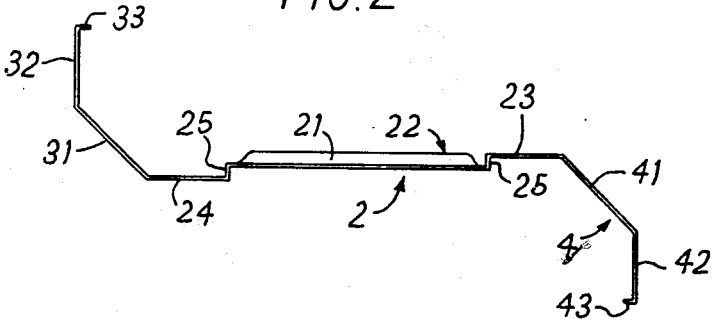
FIG. 2 shows the relative dimensions of the spanning member used in FIG. 1.
Figure 3A:
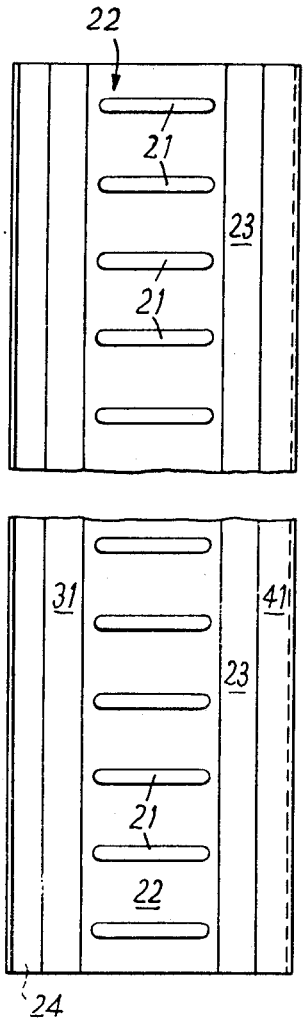
FIGS. 3A–3D show in plan and in section two members similar to that of FIGS. 1 and 2.
Figure 3B:
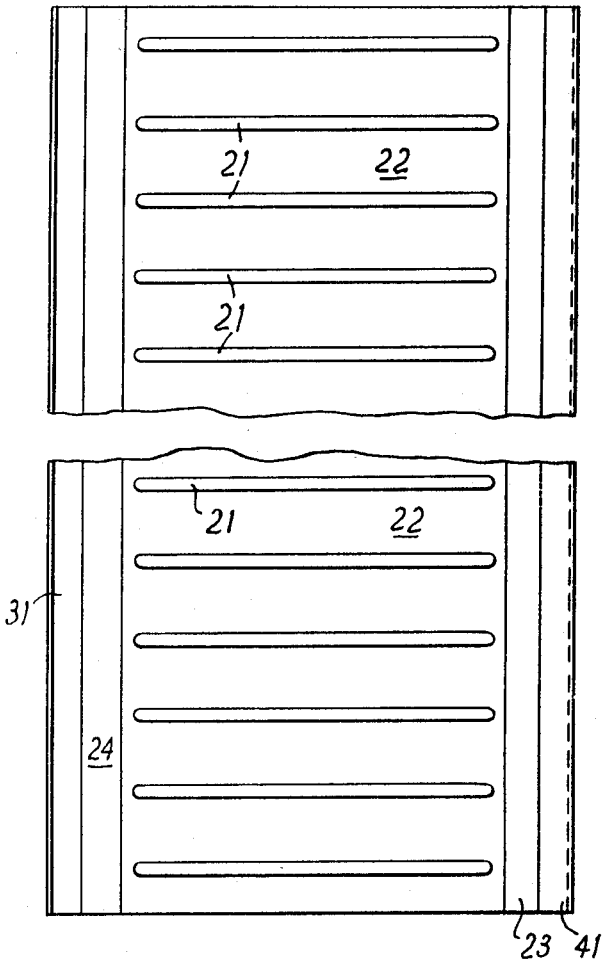
Figure 3C:
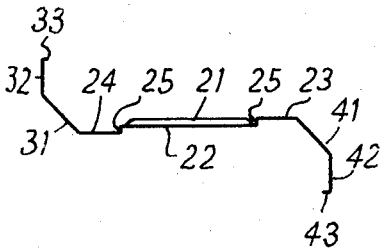
Figure 3D:
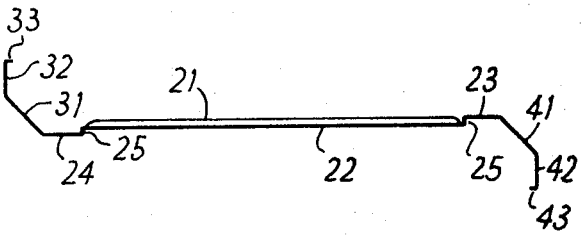

Turning to FIG. 2 the member 1 has a web 2, stiffened against buckling for structural use by means of transverse indentations 21 formed during cold rolling and further illustrated in FIGS. 3*a* or 3*b*. This web 2 has its main part 22 bearing the indentations 21, joined to oppositely offset end portions 23,24 by oppositely directed step portions 25. Projecting from end portion 23 at an angle of 45° to the general plane of the web 2, the chord itself has a main portion 41, an extension 42, and an end flange 43. It is main portion 41 that projects at the angle of 45° to the plane of web end portion 23. Likewise, the extension 42 is inclined at an angle of 45° to the plane of main portion 41 so as to be inclined orthogonally to the plane of web end portion 23. The flange 43 is orthogonal to the extension 42 so as to abut a step portion 25 of web 2 when chords 3,4 are nested. Chord 3 likewise has main portion 31, extension 32 and flange 33 arranged similarly to the portion of chord 4. Each portion and extension 24,31,32 associated with chord 3 is dimensioned larger than each corresponding portion 23,41,42 associated with chord 4 such that chord 4 nests in chord 3 with flanges 33,43 resiliently gripping respective step portions 25. With these structural spanning members formed by the cold rolling process, a snap-fit between chords 3,4 is obtained. The dimensions of two typical structural spanning members are as follows:

| | | | |
|---|---|---|---|
| Flange 33 | 5 mm | flange 43 | 5 mm |
| extension 32 | 80 mm | extension 42 | 77 mm |
| main chord portion 31 | 100 mm | main chord portion 41 | 98 mm |
| web end portion 24 | 80 mm | web end portion 23 | 77 mm |
| step portions 25 | 12 mm | indentations 21 | 12 mm |
| web main portion 270 or 630 mm. | | | |

Whilst these dimensions are given purely for illustrative purposes, they are given to establish that the structural spanning member of this preferred embodiment may be formed from sheeting currently available in up to 1.2 meter widths. These dimensions also indicate the relative difference in dimensions between chord 3 and chord 4 enabling a snap fit.

Figures 5A, 5B, 6A, 6B, 7A, 7B:
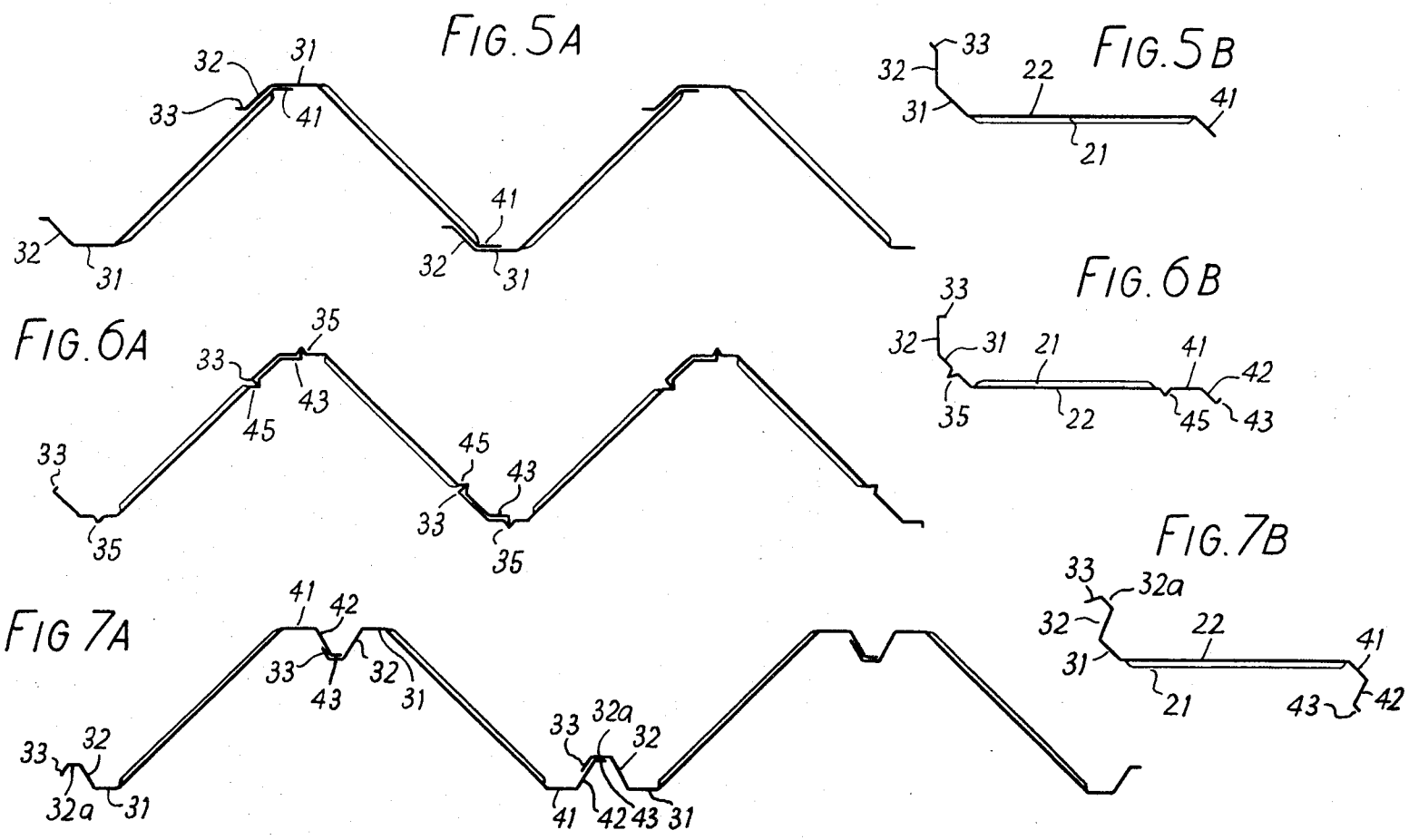
FIGS. 5A and B to 7A and B show alternatives to the configuration of FIGS. 1 and 2.

In FIGS. 5A and B to FIGS. 7A and B, the figs. designated by letter A correspond to FIG. 1 and show the manner in which structural spanning members shown individually in the Figs. designated by letter B interconnect: Figs. designated by letter B correspond to FIG. 2 and employ like numerals for like parts. Thus, the structural spanning member of FIG. 5B differs from that of FIG. 2 in that the web does not have offset end portions 23,24; chord 3 has flange 33 outwardly inclined relative to web 22 away from chord portion 32; web 4 comprises only its main portion 41. With this structural spanning member, the chord main portion 41 only partly overlaps the chord main portion 31 and these require fastenings, such as self-drilling self-tapping screws. There is no snap connection between chords 3,4. Nevertheless, this member provides a unitary structural and cladding member with also suitable provision for rain-proofing. Further rain or water-proofing may be accomplished by a bonding or sealing agent located at the lower chords between members 41,31. At the upper chords flange 33 is suitably directed for this purpose to shield the connection between chord portion 32 and web 22.

In FIG. 6B the structural spanning member again has no web offset portions 23,24 as compared with FIG. 2. It does have indentation 35 intermediate main chord portion 31 and indentation 45 between chord main portion 41 and web 22. Flanges 43 and 33 are arranged to co-operate with indentations 35,45 respectively to provide members which interconnect with a resilient snap fit to assemble into the structure of FIG. 6A. This structure also needs sealing in the gutters formed by the lower chords.

Figures 4A, 4B, 4C, 4D, 4E:
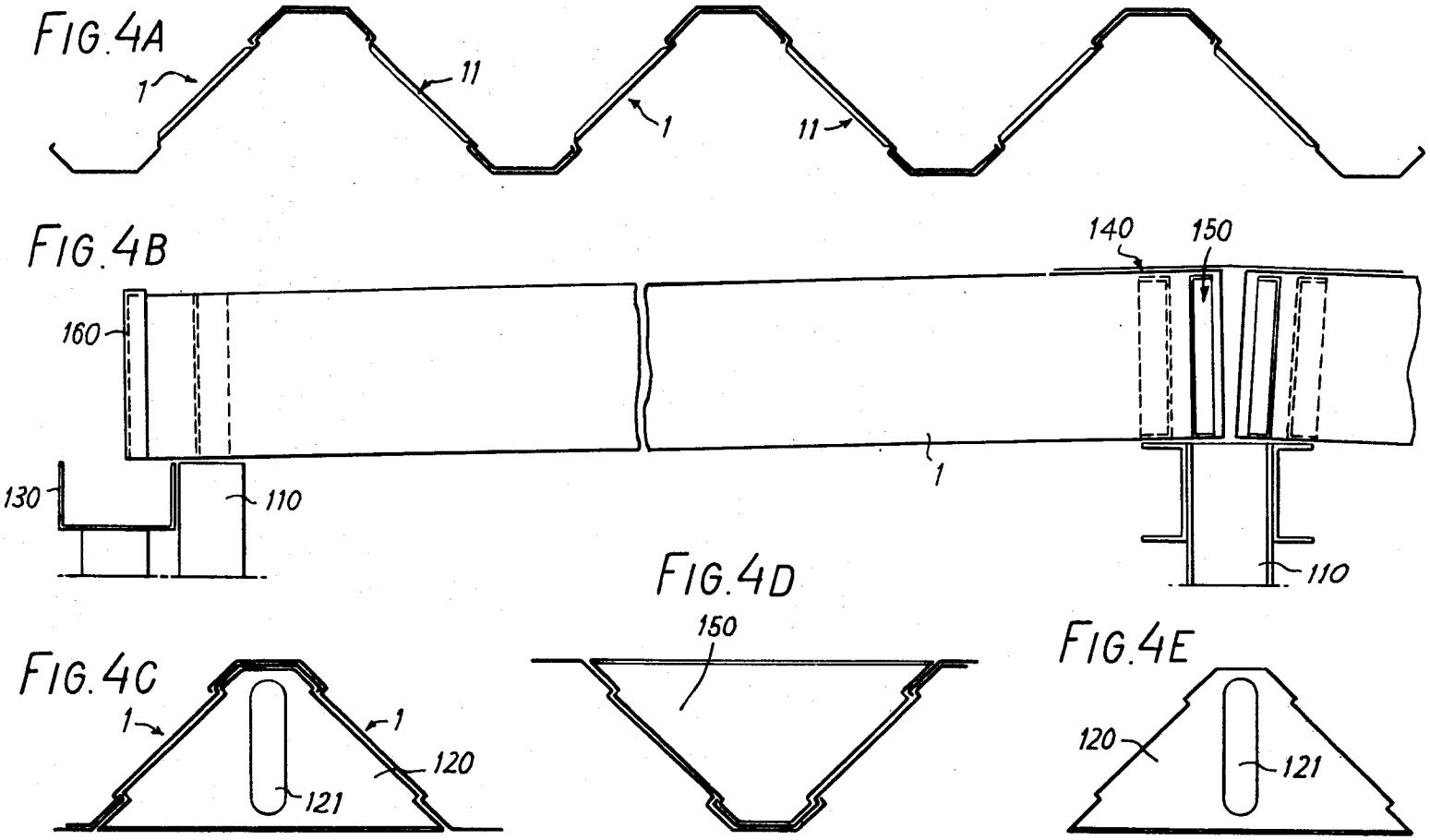
FIGS. 4A to E show fragmentary views of a roof structure.
Figure 8A:
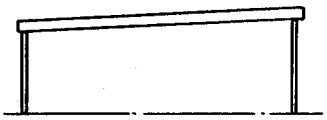
FIGS. 8A to 8D show possible roof configurations.
Figure 8B:
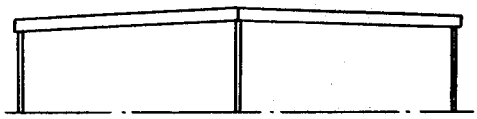
Figure 8C:
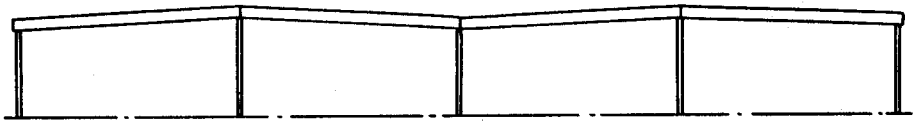
Figure 8D:
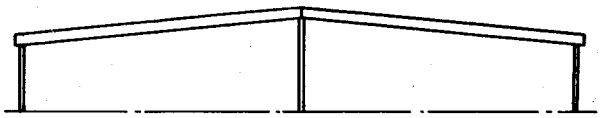

In FIG. 7B, as compared with FIG. 6B, chord portion 32 is of V configuration with one part 32*a* parallel to portion 31. Chord 3 is adapted for interconnection with chord 4 such that flange 43 and part 32*a* abut and form a partition spaced from the main plane in which the respective chords 3,4 lie parallel. This partitions the guttering formed at the lower chords and forms a channel at the upper chords. FIGS. 8A to 8C show schematically a single flat roof span in 8A a double roof span in 8B and a multiple roof span in 8C all being for flat roofs given a slant of say 1 in 40 for drainage. FIG. 8D shows a double pitched roof slanting at a gradient of 1 in 20. These configurations require guttering and weather facing for further discussion of which it is convenient to refer to FIGS. 4A to 4E. Firstly, FIG. 4A corresponds generally to FIG. 1. FIG. 4B shows a schematic longitudinal section on the line AA of FIG. 4A. Side walls 110 of the building of FIG. 8D carry the structural spanning member 1 the ends of which are closed by end support member 120 shown in end view in situ in FIG. 4C and shown per se in FIG. 4E. Support member 120 actually rests on and is connected to side wall 110. Conventional guttering 130 is arranged to collect rain water from the structural members. The configuration of support member 120, which is formed from light or heavy gauge steel sheeting and is stiffened by indentation 121 for structural use, in geometrical terms is complementary to the internal cross-section of a single pitch formed by two chords 3,4. As well as fastening support member 120 to walls 110, fastenings such as by screws are made to the structural member 1. At the faces on a ridge capping of 140 of roofing sections (FIG. 4B), weather protection is also afforded by external end closures 150, similar in shape to support member 120, but not stiffened for structural use. These end closures 150 are inserted between the exposed outer web surfaces of adjacent roof pitches. By this means, adjacent the side walls 110, the structural spanning member 1 in series to provide a roof section, also present a complete weather board along the lateral extent of the walls 110.

Returning to the structure of FIG. 1. false ceilings 150 are shown supported by the upper and lower chords 4*a*,3*b* and 4*b*, 3*a*. Cross member 152 sits between step portions 25 of the web end portions 23,24 in the upper chord region. A connecting member 154 interconnects suspended ceiling 150 with cross-member 152. In the lower chord region, a connecting bracket 158 in two parts, attached over the lower chords 3*a*,4*b* and connects directly with ceiling 150. At this location, connecting bracket 158 has portions 157 to snap fit about step portions 25 of webs 22, depending flanges 159 to connect the ceiling 150, whilst the member 158 conforms to the interconnecting lower chords 3*a*,4*b*.

It may be advantageous whilst the structural spanning members 1 are being interconnected in situ to use props below their longitudinal mid-points to avoid any separation between differently deflecting structural spanning members 1.

As shown in FIG. 4B, the member 1 may extend beyond side wall 110. If required an additional closure piece 160 may fit over the end of member 1. The closure pieces 150,160 may be formed of any weather proofing and weather resistant material, for example suitably treated steel, aluminium, glass reinforced plastic or timber. Although the structural spanning member has been herein described as a roof member, other applications include walls, bridge decking and floors. According to use, the structural spanning members may be exposed directly to the weather or covered with wood wool slabs or wood chip or other wood board or plank material, pre-cast concrete, plaster board, plastic cladding materials, and various forms of thermal insulation and weather proofing materials including asphalt. For flooring or bridge decking, it may be necessary to use heavy gauge sheeting material of, say, 3.2 mm or more.

Figure 9:
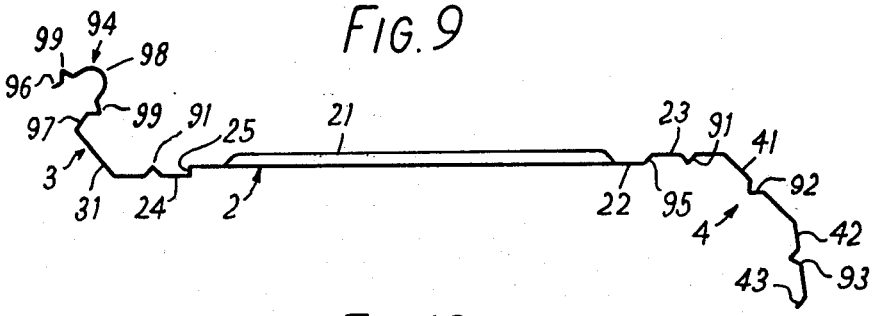
FIGS. 9 and 10 show schematically modifications of the spanning member of FIGS. 1 and 2.

In FIG. 9 there is shown in lateral section a modified configuration of the structural spanning member shown in FIGS. 1 and 2. Using like references, there is a web 2 with a main part 22 bearing indentations 21. Web 2 is joined to oppositely offset end portions 23,24 by oppositely directed step portions 25 and 95. In this embodiment each of the offset end portions 23,24 is provided with a V-notch 91 which extends longitudinally of the structural member in order to increase its rigidity. Projecting from web end portion 23 at an angle of 40° to the general plane of the web 2, the chord 4 itself has a main portion 41, an extension 42 and an end flange 43. Extension 42 is likewise inclined at an angle of 40° to the plane of chord main portion 41 so as to be inclined orthogonally to the plane of web end portion 23. Each of chord portions 41 and chord extensions are provided with respective V-notches 92,93 similar to notch 91. Flange 43 is inclined so as to lie parallel to inclined web offset 95 when a pair of chords 4 of adjacent members are nested. An extension on flange 43 may be arranged to lie parallel to web main part 22. Chord 3 likewise has a main portion 31 inclined at 40° to the web end portion 24. However, the extension 94 attached to chord main portion 31 is of generally curvilinear contour having straight sides 96,97 joined by part circular portion 94. Each side 96,97 is strengthened by a longitudinally extending V-notch 99 similar to V-notch 91. Instead as in FIG. 1 nesting pairs of chords 3,4 by inverting alternate members in a series, with this configuration of structural spanning member, alternate members in a series are turned endwise about in order that pairs of chords 4 may be nested as the upper chords and pairs of chords 3 may be nested as the lower chords, each with a snap-fit.

Figure 10:
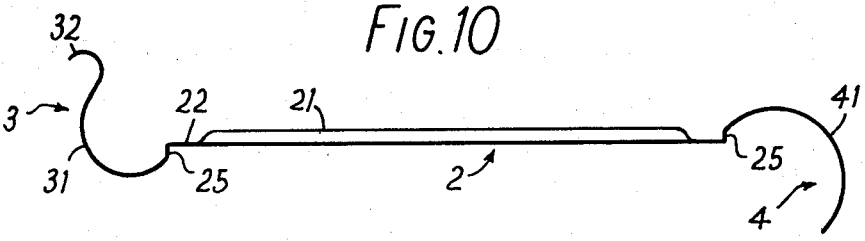

The embodiment of FIG. 10 differs from that of FIG. 9 in respect of chord 4 which is substantially semi-circular and chord 3 which is also substantially semi-circular, but which also has an extension 32 which is semi-circular and of opposite curvature to chord main part 31. Also, web portions 23,24 are omitted. Pairs of chords 4 of successive structural members are nested as the upper chords. Pairs of chords 3 are nested as the lower chords. With the embodiments of FIGS. 9 and 10, the lower chords 3 nest to give a drain channel either side of raised and coupled chords extensions 32. This gives improved sealing against the ingress of water.

The configurations of structural member have been described above with variations in chord configuration. It will be appreciated that many further configurations of web and chord are intended to fall within the scope of the appended claims.

In particular, it is envisaged that a pair of like members may be adapted for nesting when their general configuration of the top (or bottom) chord of one member is oversized with respect to the dimensions of the top (or bottom) chord of the other member to facilitate a snap-fit and the expression "like pair of structural spanning members" should be construed to embrace this embodiment as well as the embodiment in which both of the members are of like dimensions.

What is claimed is:

1. A structural spanning member for use as a beam or cross member which in a building structure itself extends linearly as an unsupported span between end supports, said structural spanning member being cold rolled from a continuous length of metallic sheeting material of initially planar configuration, the lateral dimension of said length being so formed during the cold rolling operation to provide a single web extending laterally of the sheet between oppositely directed upper and lower chords, said oppositely directed upper and lower chords being integral with the web and being directed in mutually opposite directions with respect to a general plane of the web to form half of a truncated inverted V-configuration such that a single pair of like structural spanning members are adapted to form together a single pitch of a building structure of an inverted truncated V-configuration, the web having a plurality of indentations formed therein which individually extend laterally across the web in order to strengthen the web for structural use, each of said upper and lower chords having a main planar portion, said chord main planar portions being mutually oppositely inclined with respect to said general plane of the web and mutually parallel, the upper chord further comprising a generally planar extension portion integral with its main portion and extending generally transversely with respect to the general plane of the web, the lower chord further comprising a second portion upstanding from its main portion and a further portion which extends parallel to the main portion, wherein when a pair of the members are assembled with their chords nested, said second portion and further portion provide a partition which shields a connection between adjacent members and spaces said connection above the lowermost chord main portions for the avoidance of water ingress therein.

2. A structural spanning member for use as a beam or cross member which is capable of linearly extending as an unsupported span between end supports of a building structure, said member comprising a generally planar elongated central web section, said central web section including a plurality of spaced apart indentations formed along the elongated length thereof which each extend transversely across said central web section with respect to the elongated dimension thereof, said indentations forming elongated raised portions which project out of the general plane of said central web section so as to strengthen said central web section, oppositely directed elongated chord sections extending away from opposite lateral sides of said elongated central web section, said chord sections being integral with said central web section, each of said chord sections including a planar main portion and a planar extension portion integral therewith, the planar main portions of said opposite chord sections being oppositely inclined with respect to the general plane of said central web section and mutually parallel, the planar extension portions of said opposite chord sections extending generally orthogonally with respect to the general plane of said central web section, and one of said chord sections further including an additional portion integral with the planar extension portion thereof, said additional portion extending in a direction generally parallel with the direction of the planar main portion of said one chord section, said structural spanning member being dimensioned such that when corresponding chord sections of a multiplicity of such members are nested to form repeating trunicated inverted V-configurations, they will form channels at their nested upper ends and a guttering at their lower ends.

3. The structural spanning member of claim 2 wherein said one chord section further includes a flange integral with said additional portion, said flange extending in a direction towards the general plane of said central web section.

4. The structural spanning member of claim 3 wherein the second of said chord sections further includes a flange integral with the planar extension portion thereof, said flange extending in a direction away from the plane formed by the planar extension portion thereof.

5. The structural spanning member of claim 4 wherein said flange integral with the planar extension portion of said second of said chord sections extends in a direction towards the general plane of said central web section.

6. The structural spanning member of claim 4 wherein each of said planar main portions include V-notches therein extending along their longitudinal dimensions in order to increase their rigidity.

7. The structural spanning member of claim 6 wherein each of said generally planar extension portions include V-notches therein extending along their longitudinal dimensions in order to increase their rigidity.

8. A structural spanning member for use as a beam or cross member which is capable of linearly extending as an unsupported span between end supports of a building structure, said member comprising a generally planar elongated central web section which includes a plurality of spaced apart indentations formed along the elongated length thereof which each extend transversely across said central web section with respect to the elongated dimension thereof, said indentations forming elongated raised portions which project out of the general plane of said central web section so as to strengthen said central web section, oppositely directed elongated chord sections extending away from opposite lateral sides of said elongated central web section, said chord sections being integral with said central web section, each of said chord sections including a planar main portion and a planar extension portion integral therewith, the planar main portions of said opposite chord sections being oppositely inclined with respect to the general plane of said central web section and mutually parallel, the planar extension portions of said opposite chord sections extending generally orthogonally with respect to the general plane of said central web section, said opposite chord sections being dimensioned relative to one another such that when two such spanning members are placed together to form a trunicated inverted V-configuration they will snap fit together, with a smaller chord section of one such member snap fitting within a larger chord section of the other, to thus form together a single pitch of a building structure.

9. The structural spanning member of claim 8 wherein each chord section includes a flange integral with said planar extension portions, said flanges extending in a plane generally parallel with the general plane of said central web section and towards one another.

10. The structural spanning member of claim 9 wherein each chord section includes a web end portion connected between its respective planar main portion and said central web section, each said web end portion extending in a plane generally parallel with the general plane of said central web section.

11. The structural spanning member of claim 10 wherein each chord section includes a step portion connected between its respective web end portion and said central web section, each said web end portion extending transversely to the general plane of said central web section, and in a direction opposite to one another with respect to said general plane.

12. A structural spanning member for use as a beam or cross member which is capable of linearly extending as an unsupported span between end supports of a building structure, said member comprising a generally planar elongated central web section which includes a plurality of spaced apart indentations formed along the elongated length thereof which each extend transversely across said central web section with respect to the elongated dimension thereof, said indentations forming elongated raised portions which project out of the general plane of said central web section so as to strengthen said central web section, oppositely directed elongated chord sections extending away from opposite lateral sides of said elongated central web section, said chord sections being integral with said central web section, each of said chord sections including a planar main portion, the planar main portions of said opposite chord sections being oppositely inclined with respect to the general plane of said central web section and mutually parallel, the upper chord further including a generally planar extension portion which is integral with the adjacent main portion and extends generally perpendicularly with respect to the general plane of said central web, the lower chord further including an extension portion which is in the form of a generally U-shaped member, said chord sections being dimensioned relative to one another such that when two spanning members are placed together to form a trunicated inverted V-configuration they will snap fit together with a smaller chord section of one member snap fitting within a larger chord section of the other, to thus form together a single pitch of a building structure.

13. The structural spanning member of claim 12 wherein said generally U-shaped member includes V-notches in the opposite parallel sections thereof.

14. A roof structure in which a plurality of unitary structural spanning members extend lineraly between end supports without the additional support of purlins or struts, each structural spanning member comprising a web having a plurality of indentations formed therein which individually extending laterally across the web in order to strengthen the web for structural use, each of said upper and lower chords having a main planar portion, said chord main planar portions being mutually oppositely inclined with respect to said general plane of the web and mutually parallel, the upper chord further comprising a generally planar extension portion integral with its main portion and extending generally transversely with respect to the general plane of the web, the lower chord further comprising a second portion upstanding from its main portion and a further portion which extends parallel to the main portion, wherein when a pair of like members are assembled with their chords nested, said second portion and further portion provide a partition which shields a connection between adjacent members and spaces said connection above the lowermost chord main portions for the avoidance of water ingress therein.

* * * * *